US009139349B2

(12) United States Patent
Lu

(10) Patent No.: US 9,139,349 B2
(45) Date of Patent: Sep. 22, 2015

(54) PACKING CASE

(71) Applicant: TAIWAN FU HSING INDUSTRIAL CO., LTD., Kaohsiung (TW)

(72) Inventor: Chiao-Chin Lu, Kaohsiung (TW)

(73) Assignee: TAIWAN FU HSING INDUSTRIAL CO., LTD., Gangshan District, Kaohsiung (TW)

( * ) Notice: Subject to any disclaimer, the term of this patent is extended or adjusted under 35 U.S.C. 154(b) by 0 days.

(21) Appl. No.: 13/772,340

(22) Filed: Feb. 21, 2013

(65) Prior Publication Data

US 2013/0233758 A1 Sep. 12, 2013

(30) Foreign Application Priority Data

Mar. 9, 2012 (TW) ..... 101108067 A

(51) Int. Cl.
*B65D 81/05* (2006.01)
*B65D 75/22* (2006.01)

(52) U.S. Cl.
CPC ..... *B65D 81/05* (2013.01); *B65D 75/225* (2013.01)

(58) Field of Classification Search
CPC .... B65D 81/133; B65D 81/05; B65D 81/025; B65D 5/5088; B65D 75/52; B65D 75/225; B65D 75/245
USPC ..... 206/587–594, 564, 565, 349; D9/415; 220/315
See application file for complete search history.

(56) References Cited

U.S. PATENT DOCUMENTS

| | | | | | |
|---|---|---|---|---|---|
| 3,400,873 | A | * | 9/1968 | Bessett | 206/499 |
| 3,596,822 | A | * | 8/1971 | Holley | 220/4.24 |
| 3,800,998 | A | * | 4/1974 | Gask | 229/406 |
| RE29,248 | E | * | 6/1977 | Congleton | 47/77 |
| 4,512,474 | A | * | 4/1985 | Harding | 206/461 |
| 4,703,853 | A | * | 11/1987 | Byrns | 206/387.13 |
| 4,899,877 | A | * | 2/1990 | Kiernan | 206/349 |
| 5,052,557 | A | * | 10/1991 | Contino et al. | 206/427 |
| 5,129,516 | A | * | 7/1992 | Theros | 206/463 |
| 5,447,232 | A | * | 9/1995 | Chow | 206/378 |
| 6,401,932 | B1 | * | 6/2002 | Weinstein et al. | 206/779 |
| D469,686 | S | * | 2/2003 | Yang | D9/415 |
| D472,140 | S | * | 3/2003 | Yang | D9/415 |
| 8,104,616 | B2 | * | 1/2012 | Dalea et al. | 206/427 |

* cited by examiner

*Primary Examiner* — Andrew Perreault
(74) *Attorney, Agent, or Firm* — Winston Hsu; Scott Margo

(57) ABSTRACT

A packing case for packing a lock device is disclosed. The lock device includes a rose portion and a handle portion connected to the rose portion. The packing case includes a first casing, a second casing and at least one constraining structure. A first recessed portion is formed on the first casing for containing the rose portion. The second casing is combined with the first casing in a closable manner, and the handle portion is contained and constrained between the first casing and the second casing. The at least one protruding structure is disposed on the second casing for abutting against the rose portion when the second casing is combined with the first casing, so as to constrain the rose portion inside the first recessed portion.

5 Claims, 14 Drawing Sheets

PACKING CASE

BACKGROUND OF THE INVENTION

1. Field of the Invention

The present invention relates to a packing case, and more specifically, to a packing case for packing a lock device or an object.

2. Description of the Prior Art

In general, a manufacturer usually utilizes a packing case to pack a lock device for preventing scratches or damages of the lock device caused by colliding with other object during the lock device is transported or marketed. The packing case is usually made of plastic material and has a recessed portion formed by a vacuum forming process. The recessed portion is used for containing the lock device, so that the lock device could be packed inside the packing case.

In practical application, the size of the recessed portion is greater than the size of the lock device, so as not only to prevent interference between the lock device and the packing case due to the manufacturing tolerances when the lock device and the packing case are assembled, but also to facilitate the assembly of the lock device and the packing case. As a result, there is a gap accordingly formed between the lock device and the packing case when the lock device is contained in the recessed portion of the packing case. However, shaking of the lock device may frequently occur inside the packing case due to the aforesaid gap when the lock device is transported or marketed, resulting in scratches or damages of the lock device when the lock device collides with the side wall of the recessed portion. Thus, the outer appearance of the lock device could be influenced accordingly.

SUMMARY OF THE INVENTION

The present invention provides a packing case for packing a lock device. The lock device includes a rose portion and a handle portion connected to the rose portion. The packing case includes a first casing, a second casing, and at least one constraining structure. The first casing has a first recessed portion formed thereon for containing the rose portion. The second casing is combined with the first casing in a closable manner. The handle portion is contained and constrained between the first casing and the second casing. The constraining structure is disposed on the second casing for abutting against the rose portion when the second casing is combined with the first casing, so as to constrain the rose portion inside the first recessed portion.

The present invention further provides a packing case for packing an object. The packing case includes a first casing, a second casing, and at least one constraining structure. The first casing has a first recessed portion formed thereon for containing at least one part of the object. The second casing is combined with the first casing in a closable manner. The constraining structure is disposed on the second casing for abutting against the rose portion when the second casing is combined with the first casing, so as to constrain the part of the object inside the first recessed portion.

In summary, the packing case of the present invention utilizes the constraining structure to constrain the rose portion inside the first recessed portion when the first casing is combined with the second casing. Furthermore, since the handle portion is connected to the rose portion, the handle portion could also be fixed in the second recessed portion of the second casing. In addition, the packing case of the present invention could also utilize the constraining structure to constrain at least one part of an object when the first casing is combined with the second casing. In other words, the packing case of the present invention could be used for packing a lock device or other object. Accordingly, when shaking of the lock device (or the object) combined with the packing case occurs during transportation or sales in the market, the rose portion and the handle portion of the lock device (or the object) would not collide with the side walls of the first recessed portion and the second recessed portion since the rose portion and the handle portion of the lock device (or the object) are fixed in the first recessed portion and the second recessed portion respectively. In such a manner, the packing case of the present invention could prevent scratches or damages of the lock device (or the object) efficiently.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
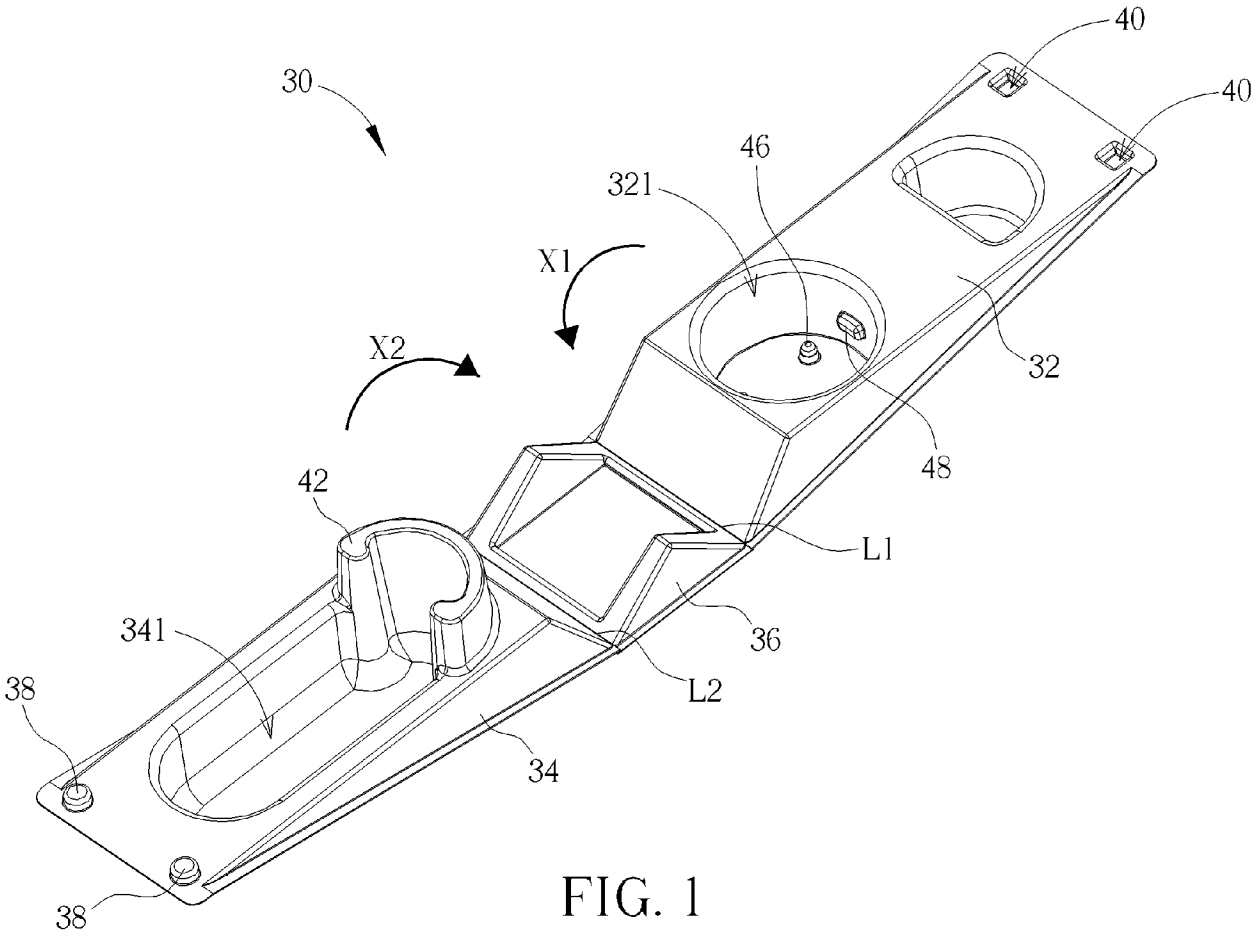
FIG. 1 is a diagram of a packing case being in an expanded status according to a first embodiment of the present invention.

Please refer to FIG. 1, which is a diagram of a packing case 30 being in an expanded status according to a first embodiment of the present invention. As shown in FIG. 1, the packing case 30 includes a first casing 32, a second casing 34. The second casing 34 is combined with the first casing 32 in a closable manner. Furthermore, the packing case 30 further includes a base 36. A side of the base 36 is connected to the first casing 32. A first foldable line L1 is selectively formed between the first casing 32 and the base 36 so that the first casing 32 could be foldable relative to the base 36 along the first foldable line L1. Another side of the base 36 is connected to the second casing 34. A second foldable line L2 is selectively formed between the second casing 34 and the base 36 so that the second casing 34 could be foldable relative to the base 36 along the second foldable line L2. In this embodiment, the first casing 32, the second casing 34, and the base 36 are made of plastic material, and the first casing 32 and the second casing 34 are integrally formed with the base 36 by a vacuum forming process.

The packing case 30 further includes a male engaging structure 38 and a female engaging structure 40. In this embodiment, the male engaging structure 38 and the female engaging structure 40 are formed on the second casing 34 and the first casing 32 respectively, but not limited thereto. For example, the male engaging structure 38 could be formed on the first casing 32 and the female engaging structure could be formed on the second casing 34 instead. In other words, the male engaging structure 38 is formed on one of the first casing 32 and the second casing 34, and the female engaging structure 40 is formed on the other one of the first casing 32 and the second casing 34. As for which design is utilized, it depends on the practical application of the packing case 30.

Figure 2:
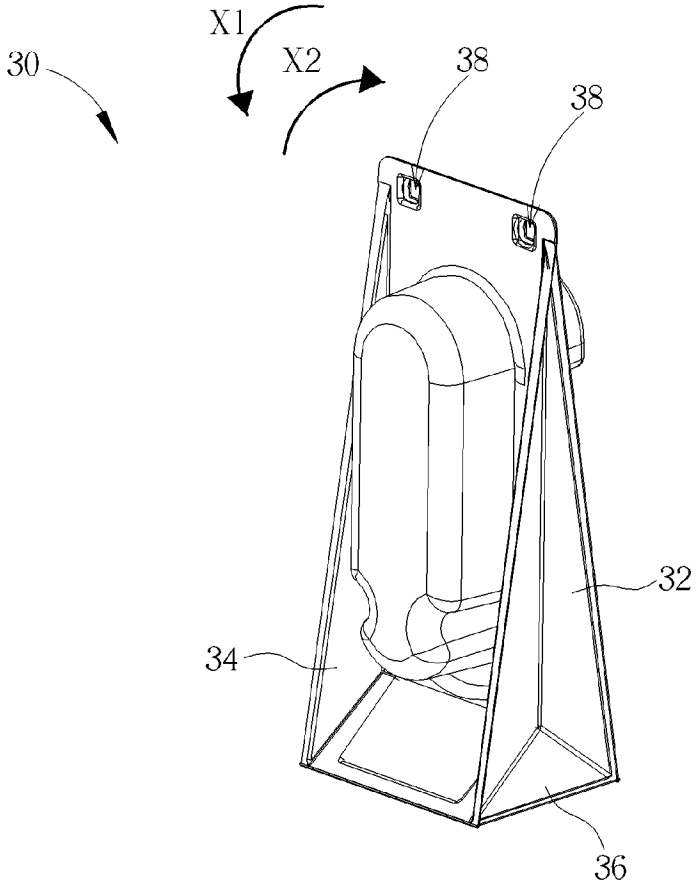
FIG. 2 is a diagram of the packing case in FIG. 1 being in a combined status.
Figure 3:
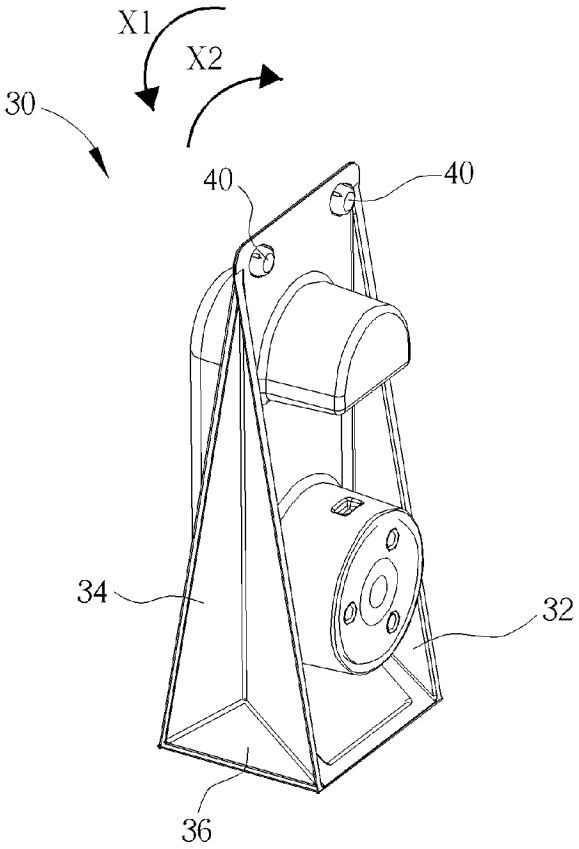
FIG. 3 is a diagram of the packing case in FIG. 2 being in the combined status at another viewing angle.

Please refer to FIGS. 1-3. FIG. 2 is a diagram of the packing case 30 in FIG. 1 being in a combined status. FIG. 3 is a diagram of the packing case 30 in FIG. 2 being in the combined status at another viewing angle. As shown in FIGS. 1-3, when the first casing 32 and the second casing 34 respectively bend to a combined position as shown in FIG. 2 and FIG. 3 relative to the base 36 along a first direction X1 and a second direction X2 as shown in FIG. 1, the female engaging structure 40 could be engaged with the male engaging structure 38 to fix the first casing 32 to the second casing 34. In such a manner, the second casing 34 could be combined with the first casing 32 to make the packing case 30 be in the combined status as shown in FIG. 2. In this embodiment, the base 36 could be substantially a triangular structure. When the packing case 30 is in the combined status, the first casing 32 and the second casing 34 abut against two adjacent side surfaces of the triangular structure respectively (as shown in FIG. 2 and FIG. 3), so as to make the first casing 32, the second casing 34 and the base 36 form a triangular structure cooperatively.

In this embodiment, the male engaging structure 38 could be a protruding pillar, and the female engaging structure 40 could be an engaging hole (as shown in FIG. 1). When the second casing 34 is combined with the first casing 32, the protruding pillar is inserted into the engaging hole tightly so that the first casing 32 could be fixed to the second casing 34. It should be mentioned that the structural designs of the male engaging structure 38 and the female engaging structure 40 are not limited to this embodiment. For example, the male engaging structure 38 and the female engaging structure 40 could also be a male button and a female button respectively. Via engagement of the male button and the female button, the first casing 32 could also be fixed to the second casing 34 at the combined position as shown in FIG. 2. In other words, all designs of utilizing a male engaging structure and a female engaging structure to fix the first casing 32 to the second casing 34 may fall within the scope of the present invention.

In this embodiment, the packing case 30 includes two male engaging structures 38 and two female engaging structures 40 corresponding to the two male engaging structures 38, but not limited thereto. For example, the packing case 30 could only include one male engaging structure 38 and one female engaging structure 40. In other words, the packing case 30 could include at least one male engaging structure 38 and at least one female engaging structure 40.

Furthermore, when a user wants to open the packing case 30 in the combined status as shown in FIG. 2 and FIG. 3, the user just needs to pull open the first casing 32 and the second casing 34 to make the male engaging structure 38 disengage from the female engaging structure 40. At this time, the first casing 32 and the second casing 34 could rotate relative to the base 36 respectively along second direction X2 and the first direction X1 as shown in FIG. 2 and FIG. 3. In such a manner, the packing case 30 could be expanded to the expanded status as shown in FIG. 1.

In summary, via the first foldable line L1 and the second foldable line L2, the first casing 32 and the second casing 34 could be in the expanded status or in the combined status relative to the base 36. In other words, the second casing 34 could be foldably combined with the first casing 32 via the first foldable line L1 and the second foldable line L2. Furthermore, when the first casing 32 and the second casing 34 are in the combined status, the first casing 32 and the second casing 34 could be fixed at the combined position via engagement of the male engaging structure 38 and the female engaging structure 40.

Figure 4:
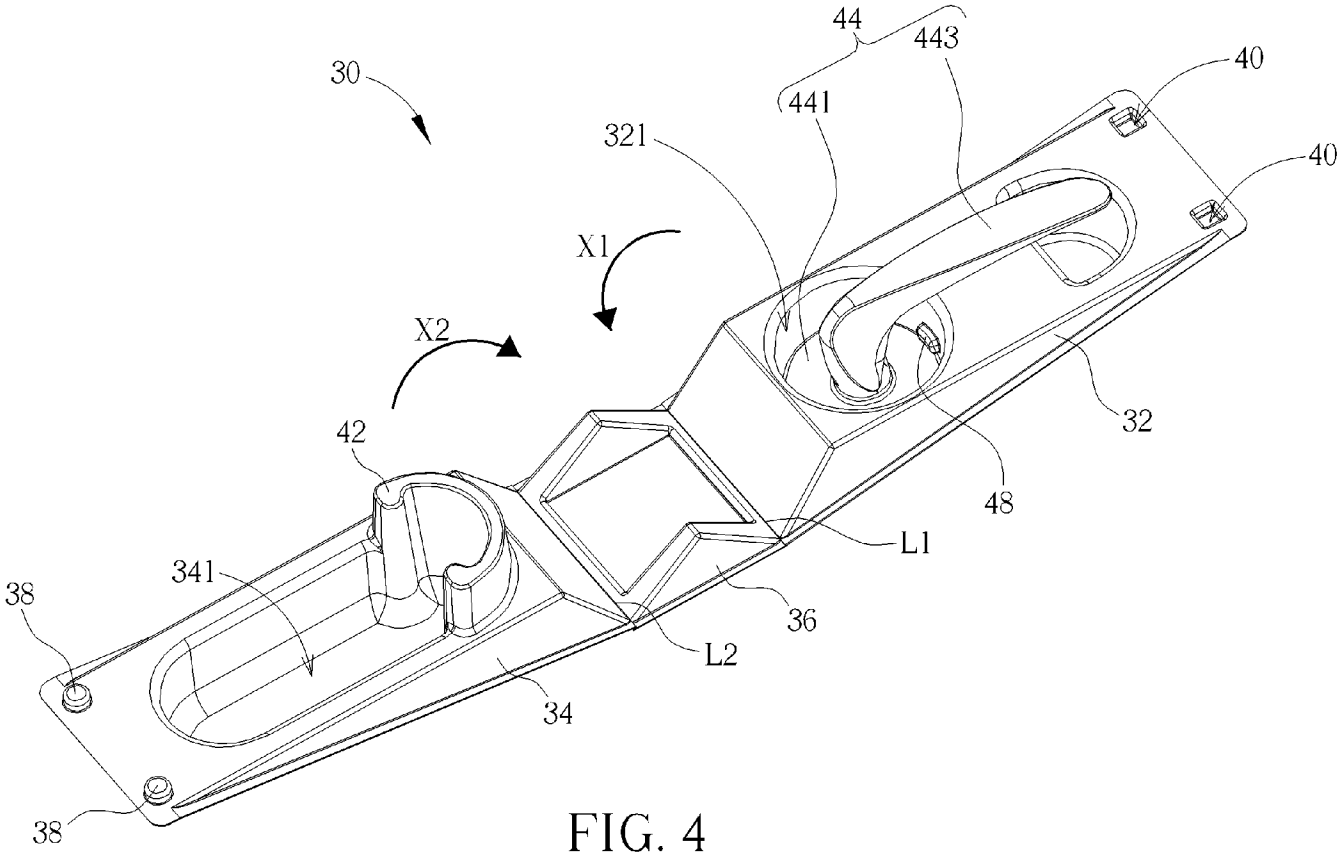
FIGS. 4-5 show the assembly process of the packing case and a lock device.
Figure 5:
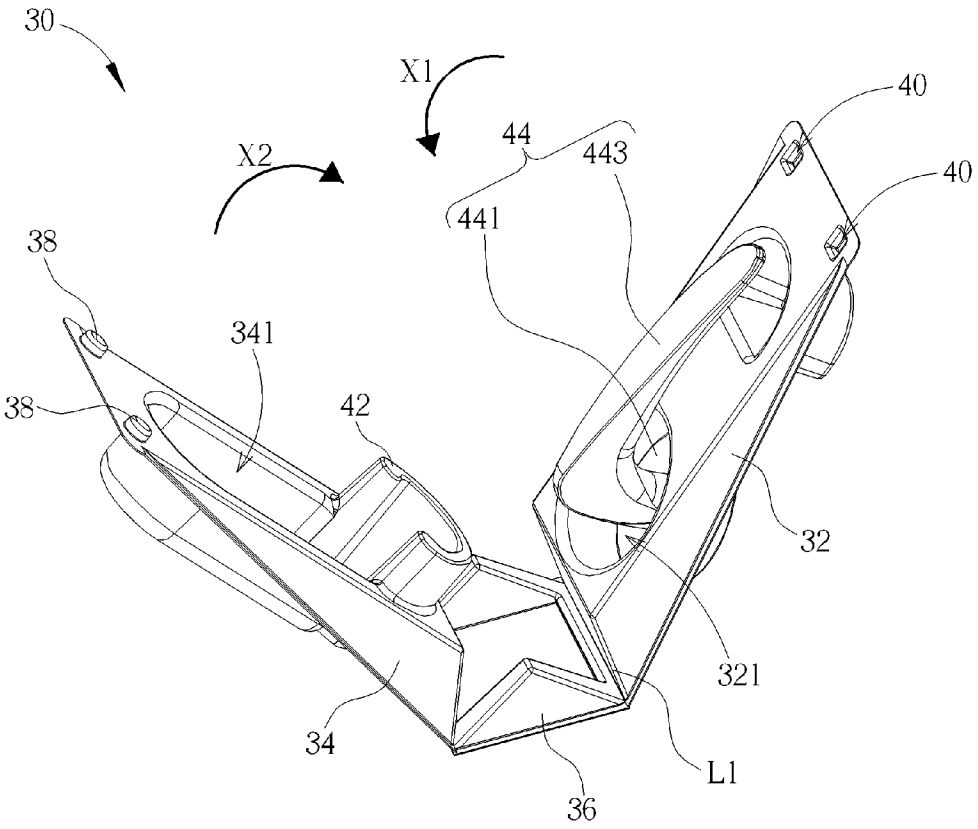

To be more specific, a first recessed portion 321 is formed on the first casing 32, and a second recessed portion 341 is formed on the second casing 34. Furthermore, the packing case 30 further includes a constraining structure 42. The constraining structure 42 is disposed on the second recessed portion 341. In this embodiment, the constraining structure 42 protrudes from the second casing 34 and is located around the second recessed portion 341. Please refer to FIG. 4 and FIG. 5, which show the assembly process of the packing case 30 and a lock device 44. As shown in FIG. 4 and FIG. 5, the packing case 30 could be used for packing the lock device 44. The lock device 44 includes a rose portion 441 and a handle portion 443 connected to the rose portion 441. The first recessed portion 321 is used for containing the handle portion 443 of the lock device 44 when the second casing 34 is combined with the first casing 32, so as to make the handle portion 443 contained and constrained between the first casing 32 and the second casing 34.

As shown in FIG. 1, the packing case 30 further includes a first positioning structure 46 and a second positioning structure 48. The first positioning structure 46 is disposed on a bottom of the first recessed portion 321, and the second positioning structure 48 is disposed on a side wall of the first recessed portion 321. It should be mentioned that the application of the packing case 30 of the present invention is not limited to this embodiment. In other words, the packing case 30 could be also used to pack an object, such as an optical disk. That is, as long as a contour of at least one part of the object conforms to the first recessed portion 321 or the second recessed portion 341, the object could be packed by the packing case 30 for protection.

Figure 6:
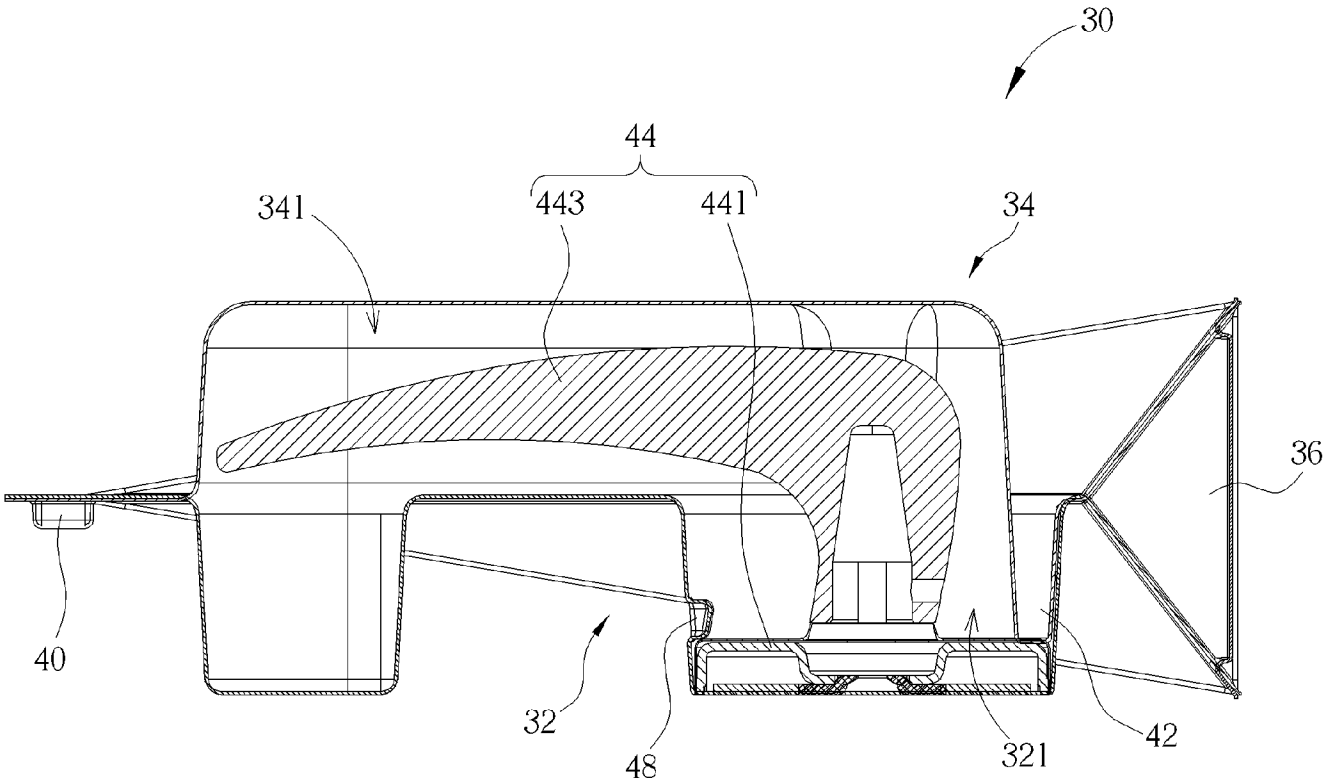
FIG. 6 is a sectional diagram of the packing case and the lock device being in the combined status.

More detailed description for utilizing the packing case 30 to pack the lock device 44 is provided as follows. Please refer to FIGS. 4-6. FIG. 6 is a sectional diagram of the packing case 30 and the lock device 44 being in the combined status. As shown in FIGS. 4-6, when the user utilizes the packing case 30 to pack the lock device 44, the user just needs to align the rose portion 441 of the lock device 44 with the first positioning structure 46 first, and then puts the rose portion 441 into the first recessed portion 321 of the first casing 32 so that the rose portion 441 could be contained in the first recessed portion 321 (as shown in FIG. 4). At this time, the second positioning structure 48 could press the rose portion 441 of the lock device 44 into the first recessed portion 321 (as shown in FIG. 6). In other words, in the aforesaid assembly process, the second positioning structure 48 and the first positioning structure 46 could be used for fixing the rose portion 441 in the first recessed portion 321.

Subsequently, the user could respectively rotate the first casing 32 and the second casing 34 via a position as shown in FIG. 5 to the combined position as shown in FIGS. 2-3 along the first direction X1 and the second direction X2 relative to the base 36. At this time, the male engaging structure 38 is combined with the female structure 40 and then the peripheries of the first casing 32 and the second casing 34 are connected to each other by a fusion-bonding process. Accordingly, the packing case 30 is in the combined status, the first casing 32 is combined with the second casing 34, and the male engaging structure 38 is engaged with the female engaging structure 40. Thus, the first casing 32 and the second casing 34 could be fixed at the combined position so as to complete packing of the lock device 44.

When the user wants to take the lock device 44 out of the packing case 30, the user just needs to remove the fusion-bonding part on the periphery of the packing case 30 and then pull open the first casing 32 and the second casing 34 so as to make the male engaging structure 38 disengage from the female engaging structure 40. Subsequently, the user could rotate the first casing 32 and the second casing 34 to be the expanded status as shown in FIG. 1 relative to the base 36. To be noted, the base 36 could be an omissible component, meaning that the packing case 30 could only include the first casing 32 and the second casing 34. That is, after the lock device 44 is packed between the first casing 32 and the casing 34 and the male engaging structure 38 is then engaged with the female engaging structure 40 to fix the first casing 32 to the second casing 34, the lock device 44 could be packed by a two-piece structure formed by the first casing 32 and the second casing 34.

As shown in FIG. 6, the first casing 32 is combined with the second casing 34. At this time, the constraining structure 42 is inserted into the first recessed portion 321 of the first casing 32 and abuts against the rose portion 441 of the lock device 44 so as to fix the rose portion 441 in the first recessed portion 321. Furthermore, since the handle portion 443 is connected to the rose portion 441, the handle portion 443 could also be fixed in the second recessed portion 341 of the second casing 34 accordingly. In such a manner, when shaking of the lock device 44 combined with the packing case 30 occurs during being transported or marketed, the rose portion 441 of the lock device 44 and the handle portion 443 would not collide with the side walls of the first recessed portion 321 and the second recessed portion 341. Accordingly, the packing case 30 of the present invention could prevent scratches or damages of the lock device 44 efficiently.

Figure 7:
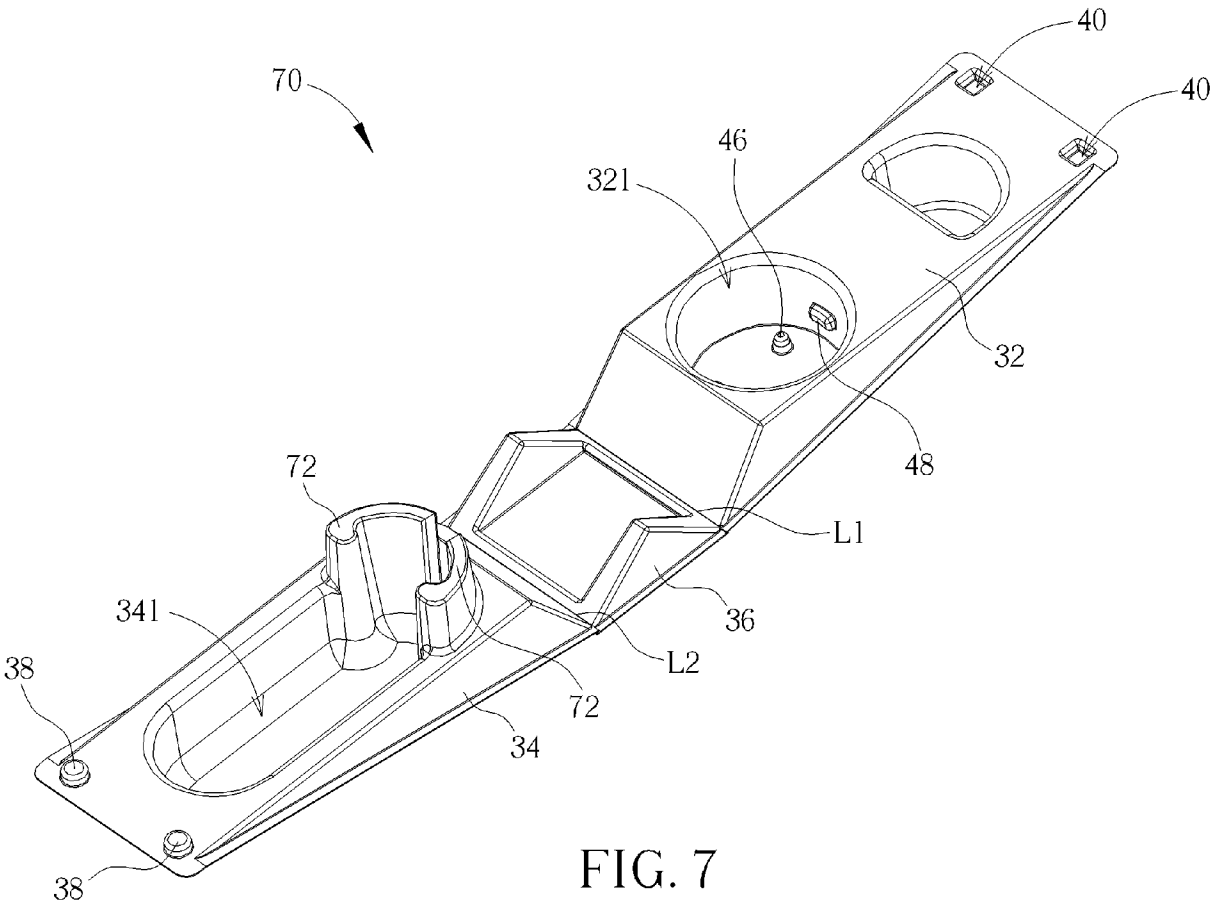
FIG. 7 is a diagram of a packing case according to a second embodiment of the present invention.

Number of the constraining structures 42 is not limited to one mentioned in the aforesaid embodiment. For example, please refer to FIG. 7, which is a diagram of a packing case 70 according to a second embodiment of the present invention. As shown in FIG. 1 and FIG. 7, the major difference between the packing case 70 and the packing case 30 is that the packing case 70 includes two constraining structures 72. When the first casing 32 is combined with the second casing 34, each constraining structure 72 is inserted into the first recessed portion 321 of the first casing 32 and abuts against the two sides of the rose portion 441 of the lock device 44, so as to fix the rose portion 441 in the first recessed portion 321. To be noted, components both mentioned in FIG. 7 and FIG. 1 represent components with similar functions and structures, and the related description is therefore omitted herein for simplicity.

Figure 8:
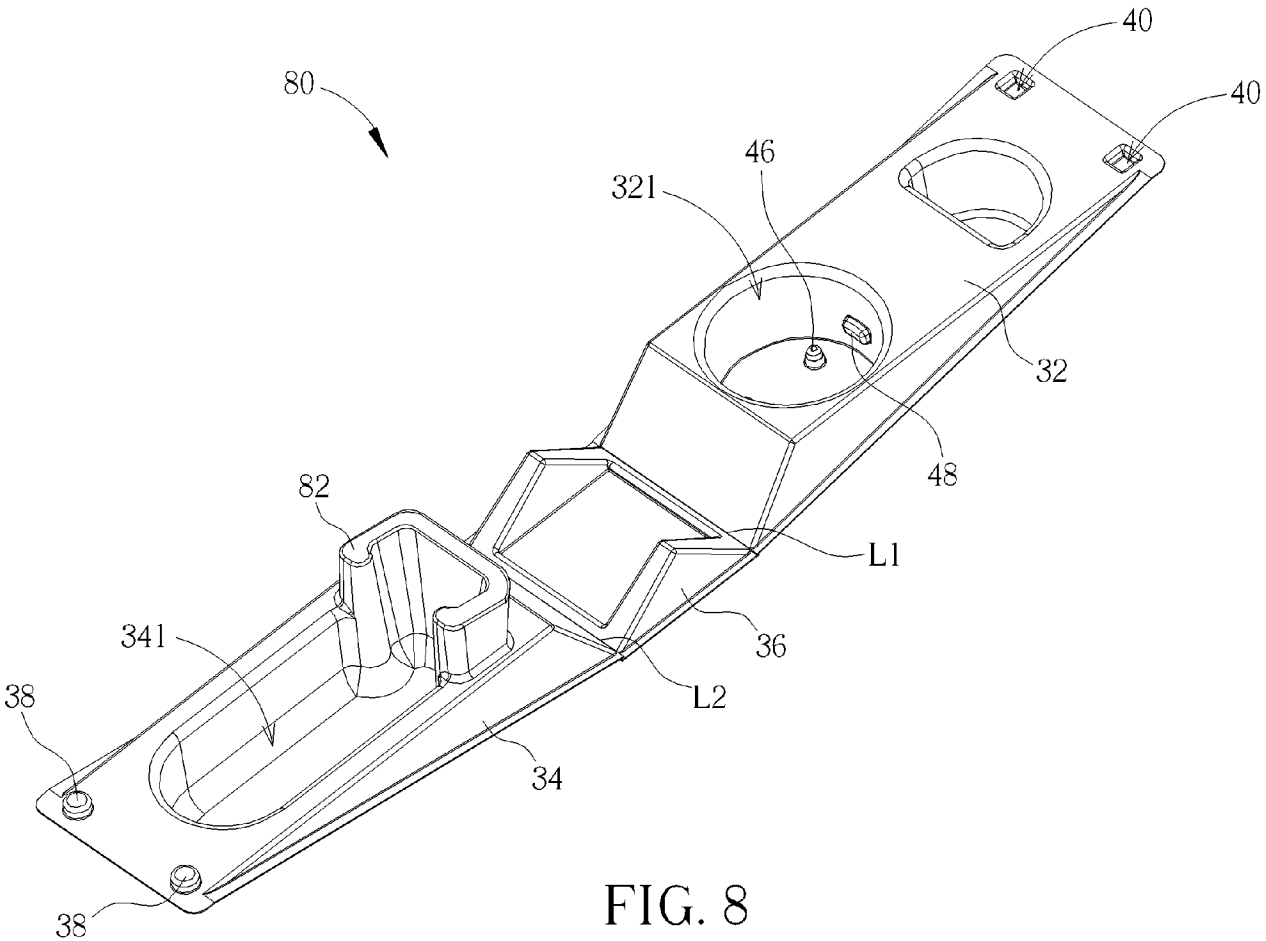
FIG. 8 is a diagram of a packing case according to a third embodiment of the present invention.

Furthermore, a section of the constraining structure 42 of the packing case 30 is a semi-circular shape (as shown in FIG. 1), but not limited thereto. For example, please refer to FIG. 8, which is a diagram of a packing case 80 according to a third embodiment of the present invention. As shown in FIG. 1 and FIG. 8, the major difference between the packing case 80 and the packing case 30 is that a section of the constraining structure 82 of the packing case 80 is U-shaped. When the first casing 32 and the second casing 34 of the packing case 80 are combined with each other, the constraining structure 82 is inserted into the first recessed portion 321 of the first casing 32 and abuts against the rose portion 441 of the lock device 44, so as to fix the rose portion 441 in the first recessed portion 321. To be noted, components both shown in FIG. 8 and FIG. 1 represent components with similar structures and functions, and the related description is therefore omitted herein for simplicity.

In the aforesaid embodiments, the rose portion 441 and the handle portion 443 of the lock device 44 are a circular structure and a striped structure respectively. For conforming to the shapes of the rose portion 441 and the handle portion 443, the first recessed portion 321 of the first casing 32 has a circular shape and the second recessed portion 341 of the second casing 34 has a rectangular shape. In such a manner, when the first casing 32 is combined with the second casing 34, the first recessed portion 321 and the second recessed portion 341 could be used for respectively containing the rose portion 441 and handle portion 443.

Figure 9:
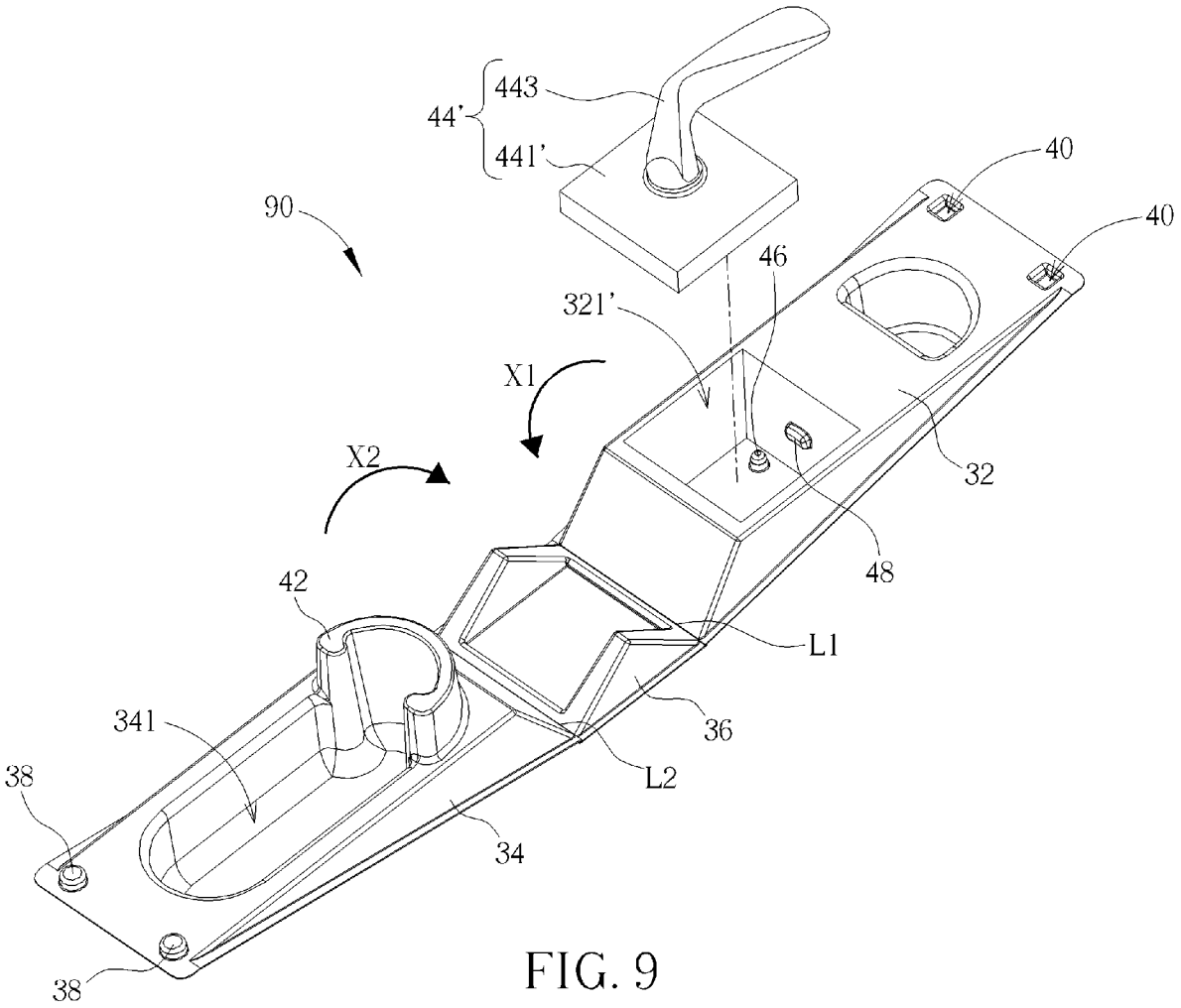
FIG. 9 is a diagram of a packing case according to a fourth embodiment of the present invention.

It should be mentioned that the structural design of the packing case is not limited to the aforesaid embodiments. For example, please refer to FIG. 9, which is a diagram of a packing case 90 according to a fourth embodiment of the present invention. As shown in FIG. 4 and FIG. 9, the major difference between the packing case 90 and the packing case 30 is that a first recessed portion 321' of the first casing 32 of the packing case 90 has a square shape. In such a manner, the packing case 90 could be used to pack a lock device 44', of which a rose portion 441' and a handle portion 443 are a square structure and a striped structure respectively. To be noted, the shape of the first recessed portion of the first casing of the present invention is not limited to the aforesaid embodiment. For example, the first recessed portion of the first casing could have a pentagon shape or a hexagon shape instead. In other words, all designs in which the shape of the first recessed portion could conform to the shape of the rose portion may fall within the scope of the present invention.

Figure 10:
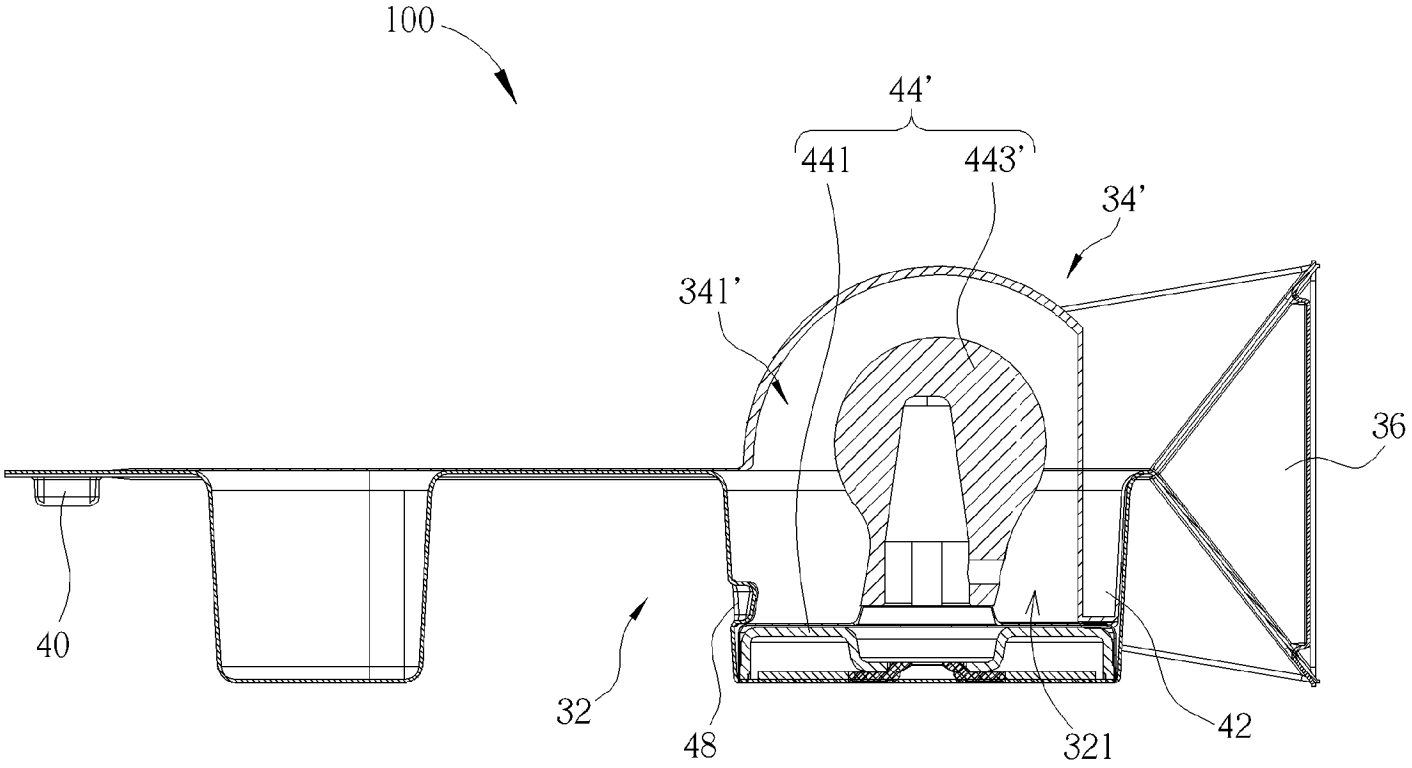
FIG. 10 is a sectional diagram of a packing case according to a fifth embodiment of the present invention.

Furthermore, the present invention could also be applied to a lock device with a round handle portion and a round rose portion. Please refer to FIG. 10, which is a sectional diagram of a packing case 100 according to a fifth embodiment of the present invention. As shown in FIG. 6 and FIG. 10, the major difference between the packing case 100 and the packing case 30 is that a second recessed portion 341' of the second casing 34 of the packing case 100 has a hemispherical shape. In such a manner, the packing case 100 could be used to pack a lock device 44", of which the rose portion 441 and a handle portion 443' are a round structure and a hemispherical striped-structure respectively. To be noted, the present invention could also be applied to a lock device with a round handle portion and a square rose portion. As for the related design, it could be reasoned by the fourth embodiment and the fifth embodiment and the related description is omitted herein for simplicity.

Figure 11:
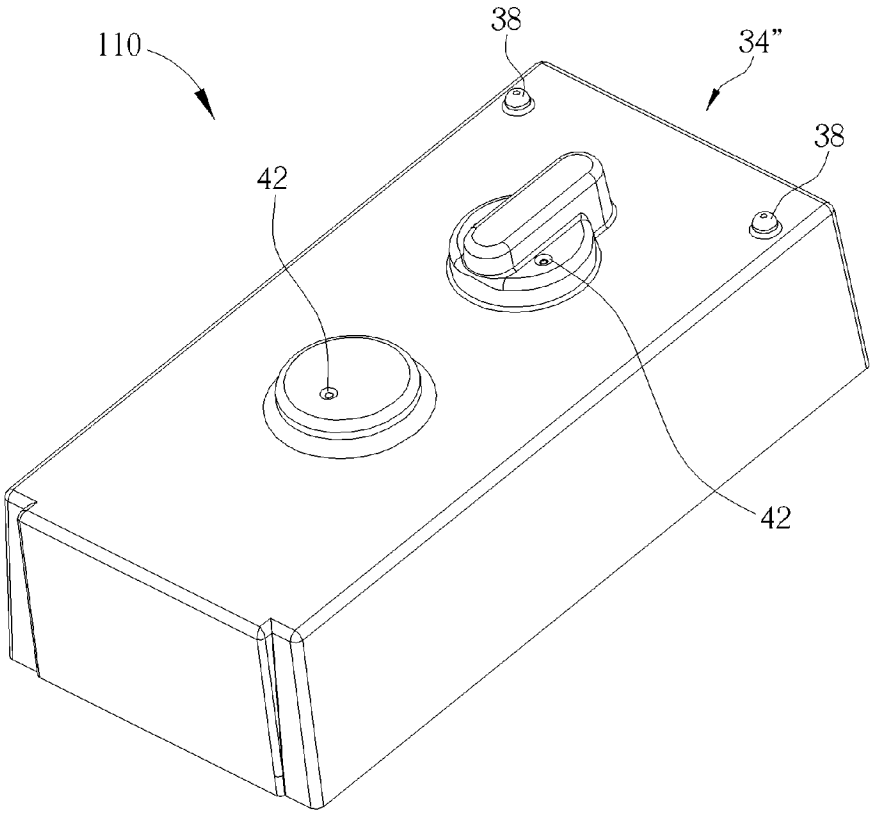
FIG. 11 is a schematic diagram of a packing case according to a sixth embodiment of the present invention.
Figure 12:
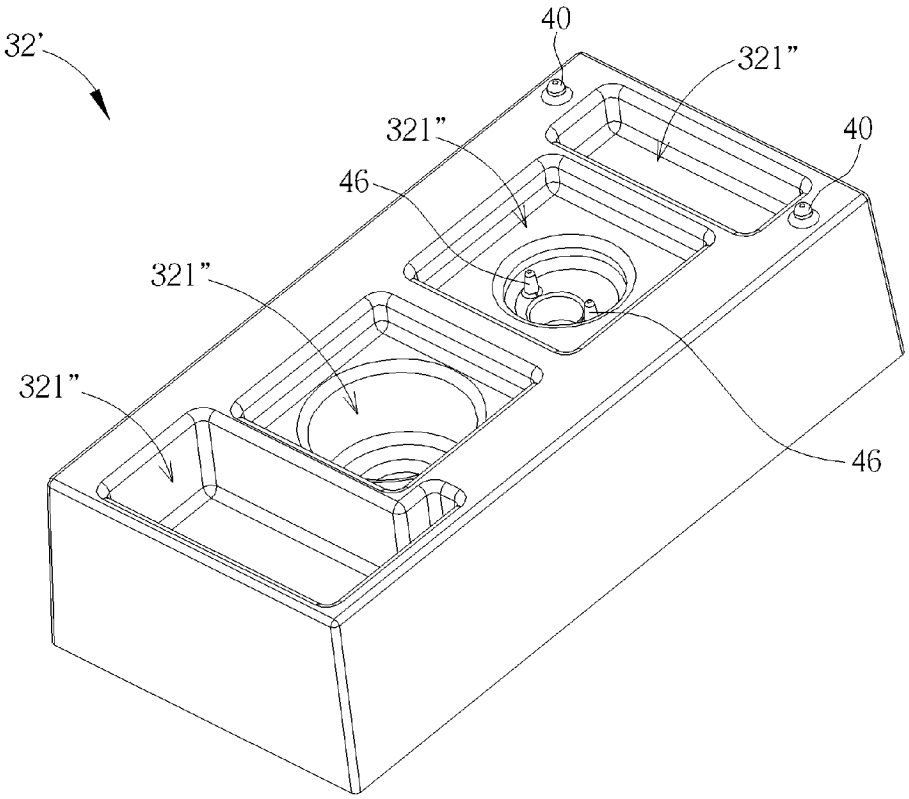
FIG. 12 is a diagram of a first casing of the packing case according to the sixth embodiment of the present invention.
Figure 13:
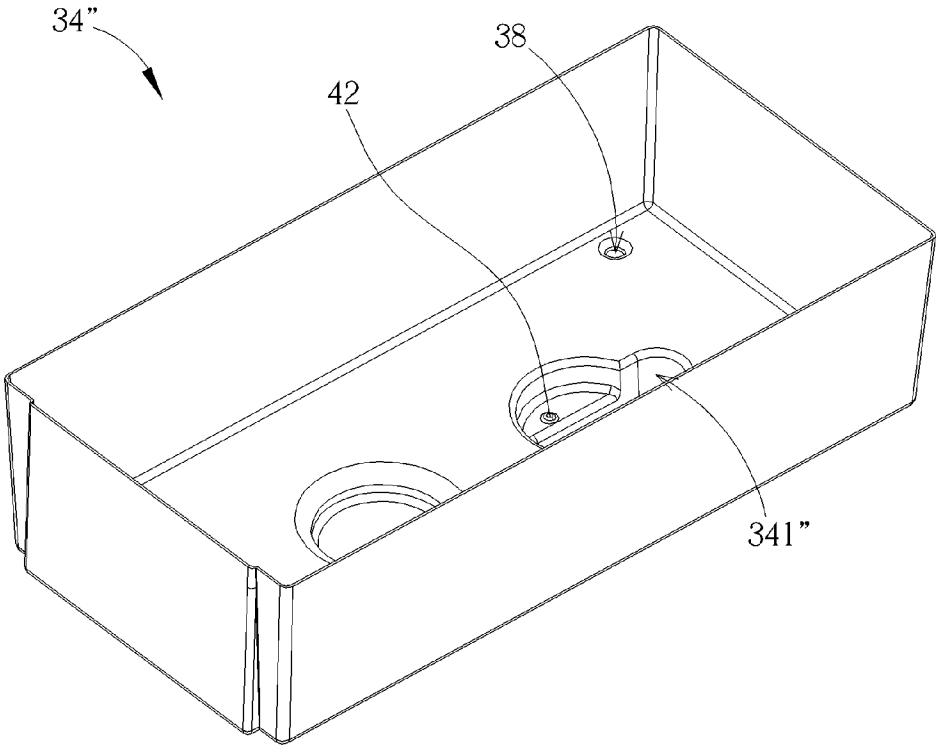
FIG. 13 is a diagram of a second casing of the packing case according to the sixth embodiment of the present invention.
Figure 14:
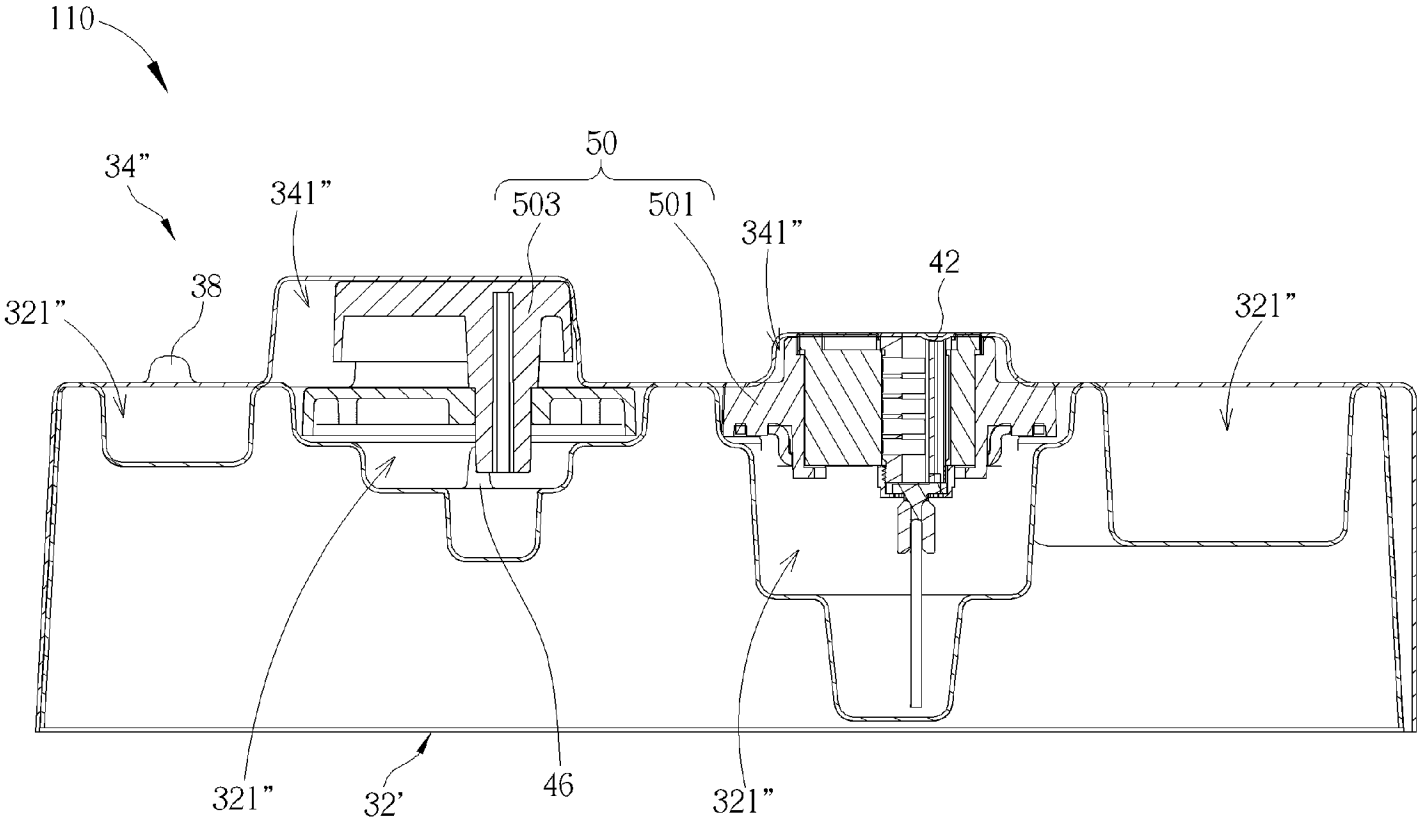
FIG. 14 is a sectional diagram of the packing case according to the sixth embodiment of the present invention.

Please refer to FIG. 11 to FIG. 14. FIG. 11 is a schematic diagram of a packing case 110 according to a sixth embodiment of the present invention. FIG. 12 is a diagram of a first casing 32' of the packing case 110 according to the sixth embodiment of the present invention. FIG. 13 is a diagram of a second casing 34" of the packing case 110 according to the sixth embodiment of the present invention. FIG. 14 is a sectional diagram of the packing case 110 according to the sixth embodiment of the present invention. As shown in FIG. 11 to FIG. 14, the major difference between the packing case 110 and the aforesaid packing case 30 is that the packing case 110 is used for packing an object 50. In this embodiment, the object 50 can include, but not limited to, a lock cylinder 501 and a lock accessory 503.

Furthermore, a first recessed portion 321" of the first casing 32' of the packing case 110 is used for containing one part of the object 50, i.e. the lock cylinder 501, and a second recessed portion 341" of the second casing 34" of the packing case 110 is used for containing another part of the object 50, i.e. the lock accessory 503. In this embodiment, there are four first recessed portions 321" formed on the first casing 32' and two second recessed portions 341" formed on the second casing 34". Amounts of the first recessed portion 321" and the second recessed portion 341" are not limited to those mentioned in this embodiment, and it depends on practical demands. As for the related design, it could be reasoned by the fourth embodiment and the fifth embodiment and the related description is omitted herein for simplicity.

Compared with the prior art, the packing case of the present invention utilizes the constraining structure to constrain the rose portion inside the first recessed portion when the first casing is combined with the second casing. Furthermore, since the handle portion is connected to the rose portion, the handle portion could also be fixed in the second recessed portion of the second casing. In addition, the packing case of the present invention could also utilize the constraining structure to constrain at least one part of an object when the first casing is combined with the second casing. In other words, the packing case of the present invention could be used for packing a lock device or other object, such as the lock cylinder and so on. Accordingly, when shaking of the lock device (or the object) combined with the packing case occurs during transportation or sales in the market, the rose portion and the handle portion of the lock device (or the object) would not collide with the side walls of the first recessed portion and the second recessed portion since the rose portion and the handle portion of the lock device (or the object) are fixed in the first recessed portion and the second recessed portion respectively. In such a manner, the packing case of the present invention could prevent scratches or damages of the lock device (or the object) efficiently.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A packing case comprising a lock device, wherein the lock device comprises a rose portion and a handle portion connected to the rose portion, the packing case comprises:

a first casing having a first recessed portion containing the rose portion;

a second casing combined with the first casing in a closable manner, the handle portion contained and constrained between the first casing and the second casing;

at least one constraining structure disposed on the second casing and the at least one constraining structure disposed in the first recessed portion of the first casing abutting against the rose portion and constraining the rose portion inside the first recessed portion;

a first positioning structure disposed on a bottom of the first recessed portion; and a second positioning structure disposed on a side wall of the first recessed portion fixing the rose portion in the first recessed portion cooperatively with the first positioning structure and the at least one constraining structure;

wherein the rose portion of the lock device is aligned with the first positioning structure, and the rose portion is in the first recessed portion of the first casing so that the rose portion is contained in the first recessed portion and the second positioning structure presses the rose portion of the lock device into the first recessed portion simultaneously.

2. The packing case of claim 1, wherein a second recessed portion is formed on the second casing and constrains the handle portion when the second casing is combined with the first casing.

3. The packing case of claim 1 further comprising:

a base connected to the first casing and the second casing, the second casing combining with the first casing when the second casing and the first casing bend to a combined position relative to the base respectively.

4. The packing case of claim 3, wherein the base is substantially a triangular structure, and the first casing and the second casing abut against two adjacent side surfaces of the triangular structure respectively when the first casing and the second casing are located at the combined position.

5. The packing case of claim 1, further comprising:

a male engaging structure formed on one of the first casing and the second casing; and a female engaging structure formed on the other one of the first casing and the second casing, and the female engaging structure engaging with the male engaging structure when the second casing is combined with the first casing, such that the first casing is fixed with the second casing.

* * * * *